United States Patent [19]

Goddard

[11] 4,130,585

[45] Dec. 19, 1978

[54] BIS-TRIAMINOGUANIDINE DECAHYDRODECABORATE, PROCESS FOR PREPARATION, AND HIGH ENERGY PROPELLANT

[75] Inventor: Terrence P. Goddard, Aptos, Calif.

[73] Assignee: Teledyne McCormick Selph, an operating division of Teledyne Industries, Inc., Hollister, Calif.

[21] Appl. No.: 762,229

[22] Filed: Jan. 24, 1977

[51] Int. Cl.[2] ..... C07C 123/00

[52] U.S. Cl. ..... 260/564 D; 149/22

[58] Field of Search ..... 149/18, 22; 260/564 D

[56] References Cited

U.S. PATENT DOCUMENTS 4,002,681 1/1977 Goddard ..... 149/18

*Primary Examiner*—Stephen J. Lechert, Jr.

*Attorney, Agent, or Firm*—David H. Semmes; Warren E. Olsen

[57] ABSTRACT

This invention relates to bis-triaminoguanidine decahydrodecarborate, which is a novel boron salt that has been found to have particular utility as a high energy monopropellant. The invention includes the triaminoguanidinium salt of decahydrodecaboric acid, and as a product of a preferred process for preparing same.

5 Claims, No Drawings

BIS-TRIAMINOGUANIDINE DECAHYDRODECABORATE, PROCESS FOR PREPARATION, AND HIGH ENERGY PROPELLANT

BACKGROUND AND BRIEF DESCRIPTION OF THE INVENTION

Boron hydride salts, in particular the nonmetal salts of decahydrodecaboric acid, had been discovered to have particular utility in the field of high energy fuels. They may be used as constituents of pyrotechnic compositions and in propellants. For example, non-metallic salts of the decahydrodecaborate ion, and exemplary uses, are disclosed in the co-pending applications of common assignment entitled "Ignition and Pyrotechnic Compositions," Ser. No. 694,625, filed June 10, 1976 and "Coprecipitated Pyrotechnic Composition Processes and Resultant Products," Ser. No. 694,626, filed June 10, 1976.

The present invention teaches a new non-metal salt of decahydrodecaboric acid, which exhibits stable physical properties, and is of itself a high energy monopropellant. The compound is very unusual in that it contains only boron, nitrogen, carbon, and hydrogen, but no oxygen.

A particular objective in preparing compounds suitable for certain types of pyrotechnic usage is to achieve a high gas output and low molecular weight combustion products, when the compound is burned. Combustion products such as hydrogen ($H_2$) and nitrogen ($N_2$) gas fulfill this requirement. In preparing salts useful as pyrotechnic fuels from an anion such as decahydrodecaborate $(-2)(B_{10}H_{10}\ -2)$, it has been found advantageous to use a cation containing a high weight fraction of atomic nitrogen and hydrogen. The triaminoguanidinium ion, chemical formula $C(NHNH_2)_3{}^{+1}$ has been found to be such a cation. In addition, the corresponding BrΦnsted base of the ion, free triaminoguanidine, is a strong base, which imparts to the cation, and thus the salt, a high degree of chemical stability.

Other decahydrodecaborate (−2) salts employing guanidine chemistry have been previously investigated by the present inventor. The simple guanidine salt is disclosed in my earlier application "Bis-Guanidinium Decahydrodecaborate and a Process of Its Preparation," Ser. No. 694,627, filed June 10, 1976, which is now U.S. Pat. No. 4,002,681. This simple salt was found to be useful as a high energy pyrotechnic fuel, and was by itself thermochemically stable; i.e., has a substantial negative heat of formation as commonly defined by those practiced in the art. The compound which is the subject of the present invention, by contrast, combusts by itself releasing internal energy, without need of an additional oxidizing material, which suggests the presently taught compound has a substantial positive heat of formation. As a result, the compound taught herein is useful as a monopropellant in its own right, or alternatively, can be used with additional oxidizer to modify its combustion properties. Specifically, such inorganic oxidizing agents as potassium nitrate, quanidine nitrate and ammonium percholorate may advantageously be employed, in concentrations from 0–90%, by weight.

DETAILED DESCRIPTION OF THE INVENTION

The triaminoguanidine salt of the decahydrodecaborate (−2) ion is represented by the chemical formula.

$$(C(NHNH_2)_3)_2\ B_{10}H_{10}$$

and more accurately by the structural formula:

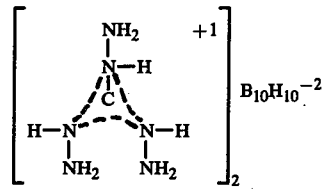

which illustrates the resonance stabilization achieved by protonating the free substituted guanidine base to form the unipositive ion.

The salt is relatively insoluble in cold water, which makes preparation by a variety of metathesis reactions feasible. A preferred method of preparation is to stoichiometrically neutralize one mole of aqueous decahydrodecaboric acid, $H_2B_{10}H_{10}$, (or as the hydronium form, $(H_30^+)_2B_{10}H_{10}{}^{-2}$), with two moles of the aqueous free base $(C(NHNH)_2)_2\ (NNH_2)$.

The aqueous decahydrodecaboric acid used as a starting material for the process of this invention is conveniently prepared by passing an amine or metal salt of the decahydrodecaborate (−2) ion through a column containing a strongly acidic ion exchange resin of the sulfonic acid type, such as a DUOLITE type C-20, manufactured by the Diamond Shamrock Corporation. Preferred starting salts are bis (triethylammonium) decahydrodecaborate (−2) and disodium decahydrodecaborate (−2). The preparation and properties of the aqueous acid itself are known, and reference may be made to Knoth U.S. Pat. No. 3,148,939, for further detail.

The free base of triaminoguanidine may be prepared by passing a chloride, nitrate, or other water soluble salt of triainoguanidine through a column containing a strongly basic ion exchange resin of the polystyrene type, such as DOWEX® 2-X8, manufactured by the Dow Chemical Company of Midland, Mich.

The neutralization preparation where the concentrations of the reacting aqueous solutions are approximately 0.3 molar, results in an immediate precipitation of the desired product. Upon filtering, washing with cold water, purification by recrystallization or reprecipitation in isopropanol, and washing with butyl acetate (to aid in drying) a brilliant white powder with a prilled appearance is recovered, which can be domonstrated to be the subject compound of a purity exceeding 97%.

Other preparative methods employing simple methathesis are obvious. For example, the product could be recovered by mixing aqueous solutions of salts containing the substituent ions, such as aqueous triethylammonium decahydrodecaborate and aqueous triaminoguanidine hydrocholoride, such that the desired product precipitates and the undesired ions remain in solution. The first method, however, may be preferred where high purities are required, because the process of obtaining the free acid and free base forms of the desired ions by ion exchange results in an added purification step.

The subject of this invention is useful as a high energy monopropellant in such devices as electric initiators or squibs, or as an ingredient to enhance burning rates. The compound may be mixed with additional materials with oxidative power to modify the combustion properties, for use in such devices as pyrotechnic deflagrating cords.

Specific reference should be had to the above-noted copending application entitled "Ignition and Pyrotechnic Compositions," Ser. No. 694,625, incorporated herein by reference, for examples of suitable and preferred species of oxidizing agents which are useful for creating a pyrotechnic mixture with the particular boron-containing salt taught herein. While the $B_{10}H_{10}^{-2}$ anion, a bicapped square antiprism polyhedral ion, has unusual stability, it is significant that the present compound achieves a resonance stabilization by protonating a free substituted quanidine base to form the unipositive ion comprising the cation. Of greater, and perhaps related, significance is the unexpected result that the simple salt bis-guanidinium decahydrodecaborate, had a substantial negative heat of formation, making the simple salt useful as a high energy pyrotechnic fuel, while the present invention exhibits a compound having a substantial positive heat of formation. Hence, the compound taught herein is useful alone, as a monopropellant, or optionally is capable of use as a component in a pyrotechnic material, through mixture with an oxidizing agent, to take further advantage of the unique decomposition properties of the decahydrodecaborate (−2) anion.

The unique product of this invention, bis-triaminoguanidinium decahydrodecaborate, is further illustrated by reference to the following example.

Example I

Fourteen hundred milliliters of aqueous free triaminoguanidine, obtained by passing a 2N solution of triaminoguanidine hydrocholoride through a column containing DOWEX ® 2-X8 exchange resin, is neutralized to pH7 with approximately 800 ml of 0.3M aqueous decahydrodecaboric acid at room temperature. A white precipitate forms immediately during the neutralization. The precipitate is recovered and washed with cold water. A small second crop of product is obtained by reducing the volume of filtrate on a rotary evaporator and chilling to 0° C.

The product is purified by dissolving the precipitate in 800 ml deionized water at 80° C. and slowly adding the hot solution to 4000 ml reagent grade isopropanol, with vigorous stirring, where the product reprecipitates. the precipitate is filtered, washed in butyl acetate, refiltered, and dried in vacuo at 140° F.

63 grams of a fluffy, brilliant white powder with a prilled appearance is obtained after drying.

Analysis: The $B_{10}H_{10}^{-2}$ in a small sample of the compound is oxidized at 80° C. with platinum black in aqueous solution to boric acid. The boric acid content of the degraded product is determined by titration against sodium hydroxide in mannitol solution. Boron content found: 32.2%. Theoretical content: 32.9%.

The infrared spectrum is obtained in a KBr pellet incorporating the compound. The spectrum between 4000 and 800 $cm^{-1}$ is virtually a superposition of spectra of triaminoguanidine hydrochloride and metallic salts of decahydrodecaboric acid with some minor shifting due to lattice effects. The characteristic peaks from the triaminoguanidinium ion are found at 3450, 3320, 1690, 1600, 1350, 1130 and 960 $cm^{-1}$; the characteristic decahydrodecaborate (−2) ion peaks are found at 2470, 1080 and 1030 $cm^{-1}$. No other major features are evident.

An analysis of solution conductivity vs. solution concentration gives a conductivity of 222 $ohm^{-1}$ $cm^2$ $mole^{-1}$ at infinite dilution, which is characteristic of a compound containing three ions, one species being an organic cation. The above analyses demonstrate that the recovered product is the desired subject of the invention.

Characteristics: The pyrotechnic utility of the subject composition is demonstrated by subjecting the material to several standard tests used to characterize explosives and pyrotechnics.

A sample of the compound, having a density of 1.22 grams/c.c., is subjected to an impact drop test, consisting of placing a 5 milligram sample of the powder on a 400 grit paper disc, and releasing a 2 kilogram weight from a calibrated height. An anvil on the weight strikes the powder sample. The sample fails to ignite 10 times in succession when the weight is released from a height of 3 centimeters. This test indicates the compound is very slightly less impact sensitive than primary explosives such as lead styphnate or lead azide (2 cm). the "fire" event is characterized by a fireball several centimeters in diameter, indicating that the igniting compound has a very high gas output.

The heat of explosion of the compound is measured by igniting a sample of the compound in a closed calorimeter bomb under argon, and measuring the temperature rise in a water bath surrounding the bomb. The heat of explosion is 1367 calories per gram of sample, which is approximately 3 times that of commonly used initiating explosives such as lead azide or lead styphnate.

The autoignition temperature of the compound is measured by recording the temperature at which the compound will not spontaneously ignite within 5 seconds when placed in contact with a hot reservoir. The measured autoignition temperature is 252° C., which illusrates the good thermal stability of the subject composition.

Obvious modifications and equivalents in the present invention will be evident to those skilled in the art, and the scope of the present invention is to be defined solely by the appended claims.

I claim:

1. The triaminoguanidinium salt of decahydrodecaboric acid, having the formula $(C(NHNH_2)_3)_2B_{10}H_{10}$.

2. A product having the formula $$(C(NHNH_2)_3)_2B_{10}H_{10}$$

said product being formed by the process of neutralizing one mole of aqueous decahydrodecaboric acid, $H_2B_{10}H_{10}$, with two moles of the aqueous free base of triaminoguanidine, $(C(NHNH)_2)_2(NNH_2)$.

3. The product according to the process of claim 2, wherein the concentrations of the reacting aqueous solutions are approximately 0.3 molar, whereby said product is precipitated, and then said product is filtered, washed with cold water and washed with butyl acetate.

4. A high energy monopropellant consisting essentially of the triaminoguanidinium salt of decahydrodecaboric acid, having the formula $(C(NHNH_2)_3)_2B_{10}H_{10}$.

5. A pyrotechnic mixture consisting essentially of the salt according to claim 1, with an oxidizing agent, wherein said salt comprises from 10% and up to 100%, by weight, of said mixture.

* * * * *